US008662823B2

(12) United States Patent
Roy et al.

(10) Patent No.: US 8,662,823 B2
(45) Date of Patent: Mar. 4, 2014

(54) FLOW PATH FOR STEAM TURBINE OUTER CASING AND FLOW BARRIER APPARATUS

(75) Inventors: Kevin John Lewis Roy, Clifton Park, NY (US); Mark Jeffrey Passino, Jr., Rensselaer, NY (US); William Patrick Rusch, Amsterdam, NY (US)

(73) Assignee: General Electric Company, Schenectady, NY (US)

( * ) Notice: Subject to any disclaimer, the term of this patent is extended or adjusted under 35 U.S.C. 154(b) by 555 days.

(21) Appl. No.: 12/949,209

(22) Filed: Nov. 18, 2010

(65) Prior Publication Data

US 2012/0128474 A1 May 24, 2012

(51) Int. Cl.
*F01D 25/00* (2006.01)

(52) U.S. Cl.
USPC ..... 415/108; 415/207; 415/208.1

(58) Field of Classification Search
USPC ..... 415/99–103, 108, 182.1, 207, 208.1, 415/211.2, 220, 232
See application file for complete search history.

(56) References Cited

U.S. PATENT DOCUMENTS

| | | | | |
|---|---|---|---|---|
| 6,422,807 | B1 | 7/2002 | Leach et al. | |
| 2006/0222489 | A1 * | 10/2006 | Mizumi et al. | 415/191 |
| 2007/0253811 | A1 * | 11/2007 | Suga et al. | 415/178 |

* cited by examiner

*Primary Examiner* — Edward Look
*Assistant Examiner* — Juan G Flores
(74) *Attorney, Agent, or Firm* — Hoffman Warnick LLC; Ernest G. Cusick

(57) ABSTRACT

A steam turbine may include a turbine section including a rotor. An inner casing is provided about the turbine, the inner casing including an upstream end, a downstream end and an inner casing exhaust port positioned at the downstream end allowing exhaust steam to exit the inner casing. An outer casing is provided about the inner casing, the outer casing including an upstream end, a downstream end and an outer casing exhaust port positioned at the upstream end of the outer casing. A flow path extends between the inner casing and the outer casing through which the exhaust steam passes in an upstream direction from the inner casing exhaust port to the outer casing exhaust port. A flow barrier may be provided in the flow path between the inner casing and the outer casing.

15 Claims, 4 Drawing Sheets

FLOW PATH FOR STEAM TURBINE OUTER CASING AND FLOW BARRIER APPARATUS

BACKGROUND OF THE INVENTION

The disclosure relates generally to steam turbines, and more particularly, to a flow path for an outer casing of a steam turbine.

Steam turbines often are very large in size and consequently have large material mass. Steam turbines also operate at high temperatures that create a number of challenges. One challenge is to ensure proper thermal response of parts, such as an outer casing. Typically, outer casings of steam turbines are not provided with any special thermal response system other than to provide some steam leakage and specific stage steam conditions. These thermal response techniques, however, use higher temperature steam. One approach to provide better thermal response has been to position the outer casing exhaust port at the middle of the lower half of the outer casing. Unfortunately, this configuration does not impact the region of the outer casing that drives clearances.

Another challenge is to provide an appropriate amount of clearance between outer and inner casings to avoid contact therebetween caused by the differential thermal expansion in parts thereof as they increase to the high operating temperatures. Most steam turbines address the differential thermal expansion by providing sufficient clearance between casing parts to handle any worst-case situation. This latter approach, however, increases machine size and may increase machine material mass. Another approach to the clearance issue has been to use heating blankets to bring the outer casing up to temperature before startup.

BRIEF DESCRIPTION OF THE INVENTION

A first aspect of the disclosure provides a steam turbine comprising: a turbine section including a rotor; an inner casing about the turbine, the inner casing including an upstream end, a downstream end and an inner casing exhaust port positioned at the downstream end allowing exhaust steam to exit the inner casing; an outer casing about the inner casing, the outer casing including an outer casing exhaust port positioned adjacent to the upstream end of the inner casing; and a flow path between the inner casing and the outer casing through which the exhaust steam passes from the inner casing exhaust port to the outer casing exhaust port.

A second aspect of the disclosure provides a steam turbine comprising: a turbine section including a rotor; an inner casing enclosing the turbine, the inner casing including an upstream end, a downstream end and an inner casing exhaust port positioned at the downstream end allowing exhaust steam to exit the inner casing; an outer casing about the inner casing, the outer casing including an outer casing exhaust port positioned adjacent to the upstream end of the inner casing; a flow path between the inner casing and the outer casing through which the exhaust steam passes from the inner casing exhaust port to the outer casing exhaust port; and a flow barrier in the flow path between the inner casing and the outer casing, wherein an end of the outer casing adjacent to the inner casing exhaust port has a shape configured to direct the exhaust steam from the inner casing exhaust port to the flow path.

A third aspect of the disclosure provides an apparatus comprising: an arcuate flow barrier having an outer extent configured for coupling to an inner portion of an outer casing of a steam turbine and an inner extent configured for coupling to an outer portion of an inner casing of the steam turbine, the arcuate flow barrier directing flow of steam in a particular direction between the inner casing and the outer casing.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
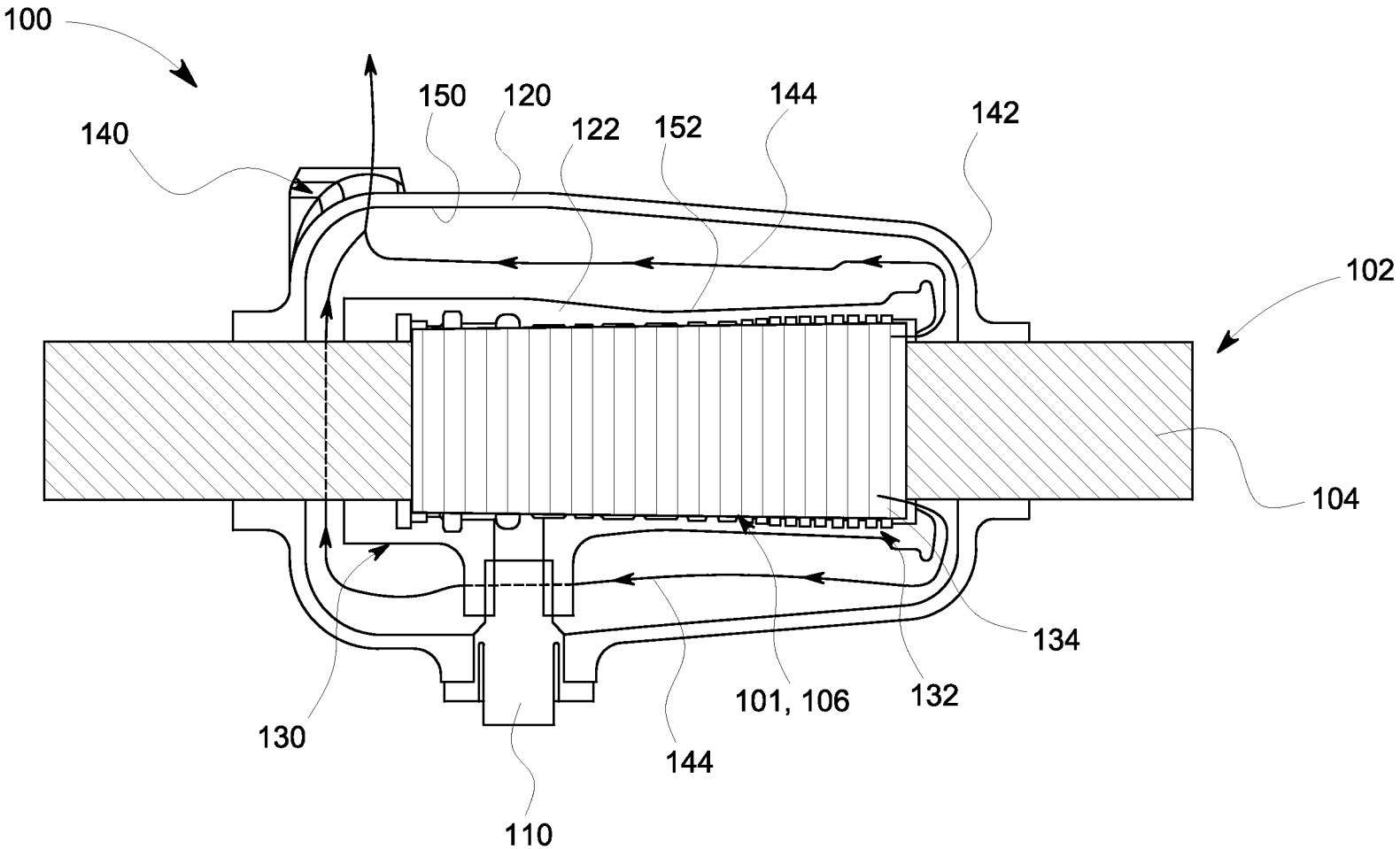
FIG. 1 shows a side cross-sectional view of a steam turbine including a flow path according to embodiments of the invention.

Referring to the drawings, FIG. 1 shows a side cross-sectional view of one embodiment of a steam turbine 100. Steam turbine 100 includes a turbine section 101 including a rotor 102 that includes a rotating shaft 104 and a plurality of axially spaced rotor wheels 106. As understood, a plurality of rotating blades (not shown) are mechanically coupled to each rotor wheel 106 within a inner casing 122. More specifically, the blades are arranged in rows that extend circumferentially around each rotor wheel 106. As also understood, a plurality of stationary vanes (not shown) extend circumferentially around shaft 104 within inner casing 122, and the vanes are axially positioned between adjacent rows of blades. The stationary vanes cooperate with the blades to form a stage and to define a portion of an operative steam flow path through turbine section 101. In operation, steam enters a steam inlet 110 of turbine section 101 and is channeled through the stationary vanes. As illustrated, steam inlet 110 is positioned intermediate an upstream end 130 and a downstream end 132 of inner casing 122 (and also outer casing 120) for delivering operative steam to inner casing 122. The vanes direct steam downstream against the blades. Steam passes through the remaining stages imparting a force on blades causing rotating shaft 104 to rotate. At least one end of steam turbine 100 may extend axially away from rotor 102 and may be attached to a load or machinery (not shown) such as, but not limited to, a dynamoelectric machine such as a generator or a motor, and/or another turbine.

Steam turbine 100 also includes an outer casing 120 that extends about inner casing 122. As noted above, inner casing 122 extends about turbine section 101. As understood, each casing 120, 122 may be formed in semi-circular sections joined along a horizontal mid-line, the upper halves of the outer and inner casings being illustrated. Inner casing 122 may include forward and aft shell sections mounted for radial contraction and expansion relative to outer casing 120. As partly noted above, inner casing 122 includes an upstream end 130, a downstream end 132 and an inner casing exhaust port 134. Inner casing exhaust port 134 may be any opening at downstream end 132 of inner casing 122 allowing exhaust steam to exit inner casing 122. As used herein, "upstream" and "downstream" indicate positions relative to an operative steam flow through turbine section 101, which is left-to-right in FIGS. 1 and 2.

In contrast to conventional steam turbines, outer casing 120 includes an outer casing exhaust port 140 that is positioned adjacent to upstream end 130 of inner casing 122. Conventionally, outer casing exhaust ports are positioned adjacent to, i.e., immediately downstream or radially outward from, inner casing exhaust port 134. Positioning of outer casing exhaust port 140 adjacent to upstream end 130 provides a flow path 144 between inner casing 122 and outer casing 120 through which the exhaust steam passes in a direction from inner casing exhaust port 134 to outer casing exhaust port 140. As used herein, "adjacent" means near or close to upstream end 130, e.g., either upstream or slightly downstream from upstream end 130. Outer casing exhaust port 140 may be radially outward relative to at least part of upstream end 130 of inner casing 122. In one embodiment, an end 142 of outer casing 120 adjacent to inner casing exhaust port 134 has a shape configured to direct the exhaust steam from inner casing exhaust port 134 to flow path 144, e.g., curved, curved with vanes or otherwise structured to direct steam towards flow path 144.

Figure 2:
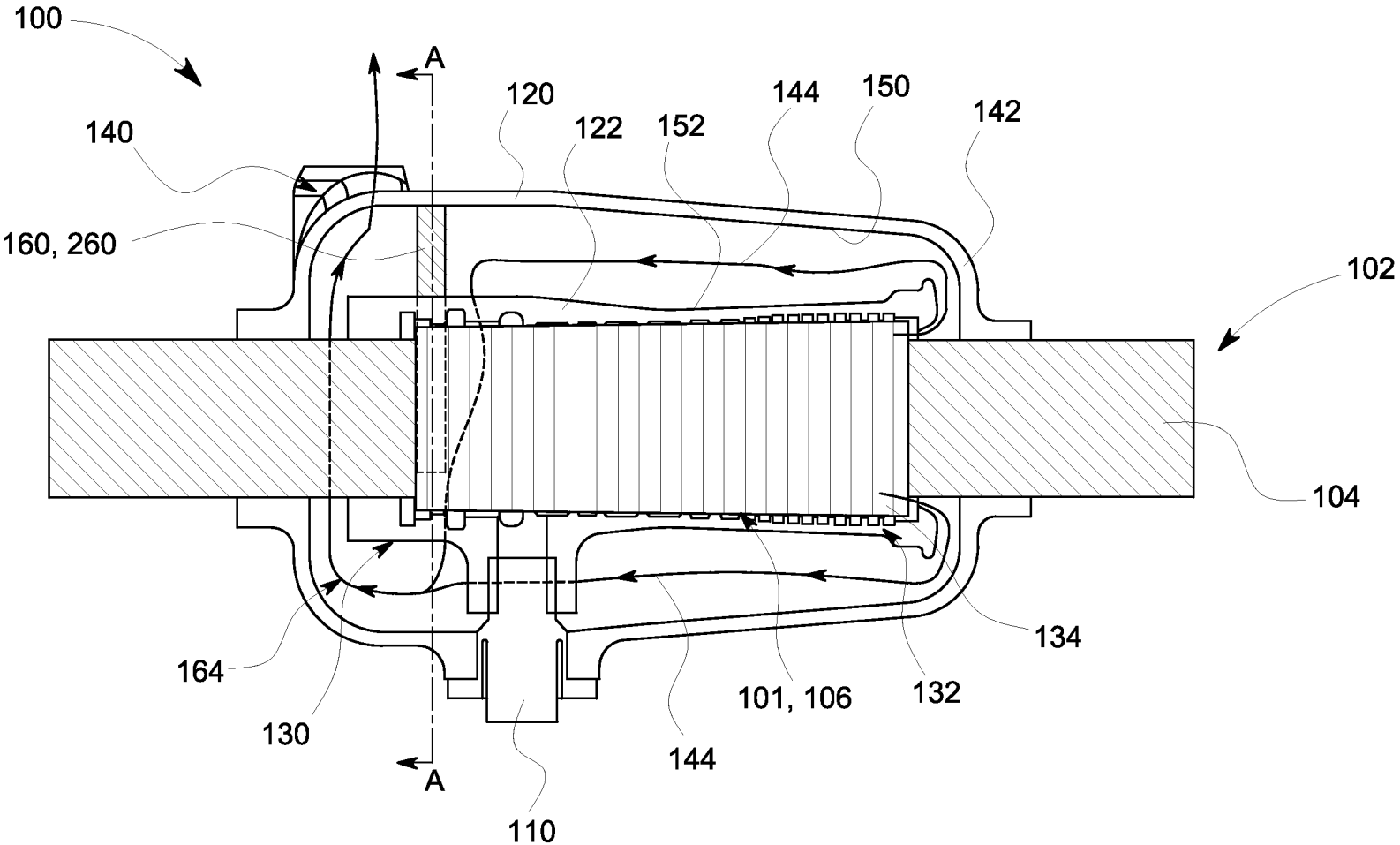
FIG. 2 shows a side cross-sectional view of a steam turbine including a flow path and a flow barrier apparatus according to embodiments of the invention.

The direction of steam flow in flow path 144 is upstream compared to the operative steam flow in turbine section 101, i.e., generally right-to-left in FIGS. 1 and 2—opposite to the operative steam flow in turbine section 101. Consequently, exhaust steam in flow path 144 passes over an inner surface 150 of outer casing 120 and an outer surface 152 of inner casing 122, cooling each casing. In particular, flow path 144 allows a temperature of outer casing 120 and a temperature of inner casing 122 to each follow a temperature of rotor 102. As used herein, "follow" means that if rotor temperature increases, outer casing and inner casing temperatures also increase such that the relative movement between rotor and casings is minimized. Similarly, if rotor temperature decreases, outer and inner casing temperatures decrease. From a technical perspective, the lower casing temperature that results permits a wider range of applicable materials for outer casing 120. Embodiments of the invention are also very simple to implement and do not require additional parts and their inherent risk of failure. Further, the ability to use lower grade materials results in lower product cost. Reduction in clearances improves the overall performance of steam turbine 100.

Figure 3:
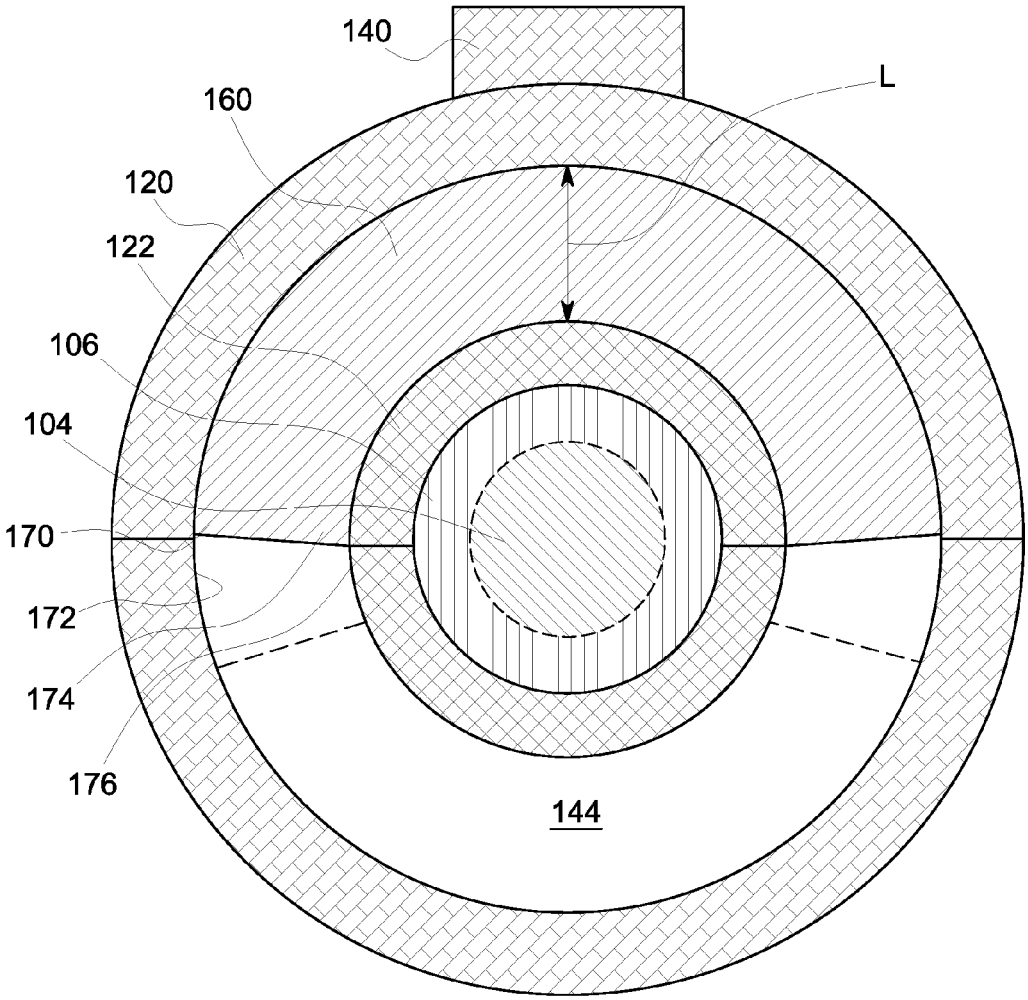
FIG. 3 shows a lateral cross-sectional view of a steam turbine including the flow path and the flow barrier apparatus according to embodiments of the invention.
Figure 4:
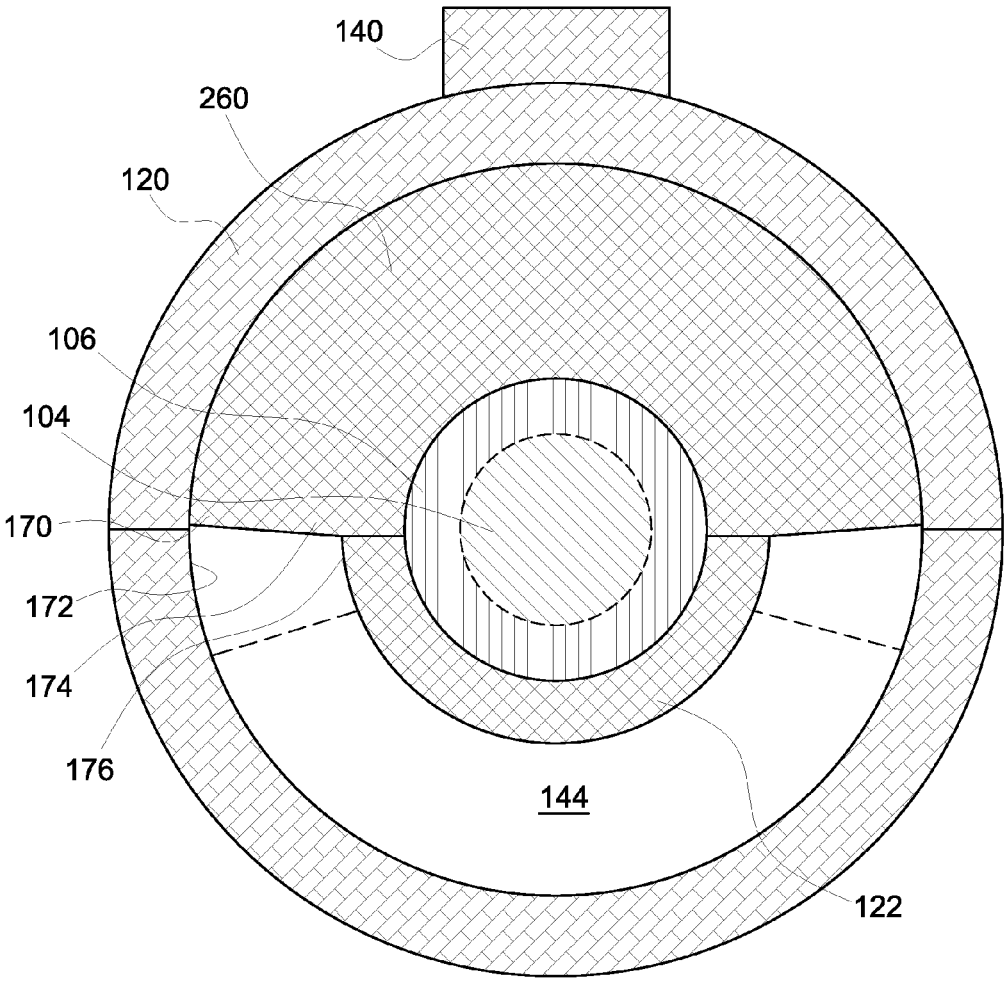
FIG. 4 shows a lateral cross-sectional view of a steam turbine including the flow path and the flow barrier apparatus according to alternative embodiments of the invention.

Referring to FIGS. 2-4, in an optional embodiment, a flow barrier 160, 260 is positioned in flow path 144 between inner casing 122 and outer casing 120. Flow barrier 160, 260 may have any shape sufficient to direct flow of steam in a particular direction between inner casing 122 and outer casing 120, but is generally arcuate as illustrated in FIGS. 3 and 4, which are cross-sectional views along line A-A in FIG. 2. Flow barrier 160, 260 may be made of any now known or later developed material capable of withstanding the environmental conditions of steam turbine 100, e.g., steel. As observed best in FIG. 2, flow barrier 160, 260 directs exhaust steam towards a lower part 164 of flow path 144 between inner casing 122 and outer casing 120. The active cooling of outer casing 120 reduces the axial clearances needed between stationary and rotating parts, which improves performance. As illustrated, in one embodiment, flow barrier 160, 260 is immediately downstream, i.e., using the direction of operative fluid flow in turbine section 101, of outer casing exhaust port 140. However, this position may not be necessary in all cases. In one embodiment, flow barrier 160, 260 includes an arcuate partition extending between approximately 160° to approximately 220° circumferentially between inner casing 122 and outer casing 120, and in one particular embodiment, partition 160, 260 extends approximately 200° circumferentially between the casings (shown via dashed lines in FIGS. 3 and 4).

As shown in FIGS. 3 and 4, arcuate flow barrier 160, 260 includes an outer extent 170 configured for coupling to an inner portion 172 (e.g., surface 150 (FIG. 2) or other internal structure) of outer casing 120 and an inner extent 174 configured for coupling to an outer portion 176 (e.g., surface 152 (FIG. 2) or other external structure) of inner casing 122. Consequently, arcuate flow barrier 160, 260 has a radial length L (FIG. 3 only) that approximately matches a space between inner portion 172 of outer casing 120 and outer portion 176 of inner casing 122. Any now known or later developed techniques for coupling parts within a steam turbine 100 and allowing appropriate thermal expansion may be employed, e.g., mechanical couplings, welding, slide joints, etc. In FIG. 3, flow barrier 160 is coupled to inner casing 122 using the aforementioned techniques. In an alternative embodiment, shown in FIG. 4, flow barrier 260 is integral with inner casing 122, i.e., it is formed as part of inner casing 122.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A steam turbine comprising:

a turbine section including a rotor;

an inner casing about the turbine, the inner casing including an upstream end, a downstream end and an inner casing exhaust port positioned at the downstream end allowing exhaust steam to exit the inner casing;

an outer casing about the inner casing, the outer casing including an outer casing exhaust port positioned adjacent to the upstream end of the inner casing; and a flow path between the inner casing and the outer casing for directing all of the exhaust steam that passes through the turbine section from the inner casing exhaust port to the outer casing exhaust port.

2. The steam turbine of claim 1, further comprising a flow barrier in the flow path between the inner casing and the outer casing.

3. The steam turbine of claim 2, wherein the flow barrier directs exhaust steam towards a lower part of the flow path between the inner casing and the outer casing.

4. The steam turbine of claim 2, wherein the flow barrier is positioned immediately downstream of the outer casing exhaust port.

5. The steam turbine of claim 2, wherein the flow barrier includes a partition extending between approximately 160° to approximately 220° circumferentially between the inner casing and the outer casing.

6. The steam turbine of claim 2, wherein the flow barrier is integral with the inner casing.

7. The steam turbine of claim 1, wherein a temperature of the outer casing and a temperature of the inner casing each follow a temperature of the rotor.

8. The steam turbine of claim 1, wherein an end of the outer casing adjacent to the inner casing exhaust port has a shape configured to direct the exhaust steam from the inner casing exhaust port to the flow path.

9. The steam turbine of claim 1, further comprising a steam inlet passing through the flow path to the inner casing.

10. A steam turbine comprising:

a turbine section including a rotor;

an inner casing enclosing the turbine, the inner casing including an upstream end, a downstream end and an inner casing exhaust port positioned at the downstream end allowing exhaust steam to exit the inner casing;

an outer casing about the inner casing, the outer casing including an outer casing exhaust port positioned adjacent to the upstream end of the inner casing;

a flow path between the inner casing and the outer casing for directing all of the exhaust steam that passes through the turbine section from the inner casing exhaust port to the outer casing exhaust port; and a flow barrier in the flow path between the inner casing and the outer casing, wherein an end of the outer casing adjacent to the inner casing exhaust port has a shape configured to direct the exhaust steam from the inner casing exhaust port to the flow path.

11. The steam turbine of claim 10, wherein the flow barrier directs exhaust steam towards a lower part of the flow path between the inner casing and the outer casing.

12. The steam turbine of claim 10, wherein the flow barrier is immediately downstream of the outer casing exhaust port.

13. The steam turbine of claim 10, wherein the flow barrier includes a partition extending between approximately 160° to approximately 220° circumferentially between the inner casing and the outer casing.

14. The steam turbine of claim 13, wherein the flow barrier includes a partition extending approximately 200° circumferentially between the inner casing and the outer casing.

15. The steam turbine of claim 10, wherein a temperature of the outer casing and a temperature of the inner casing each follow a temperature of the rotor.

* * * * *